US010472768B1

(12) United States Patent
Poikolainen et al.

(10) Patent No.: US 10,472,768 B1
(45) Date of Patent: Nov. 12, 2019

(54) FORMING SECTION FOR FORMING A FIBROUS WEB, A PAPERMAKING MACHINE COMPRISING A FORMING SECTION AND A METHOD OF FORMING A FIBROUS WEB

(71) Applicant: VALMET AKTIEBOLAG, Sundsvall (SE)

(72) Inventors: Antti Poikolainen, Jyvaeskylae (FI); Karl-Johan Tolfsson, Forshaga (SE)

(73) Assignee: VALMET AKTIEBOLAG, Sundsvall (SE)

( * ) Notice: Subject to any disclaimer, the term of this patent is extended or adjusted under 35 U.S.C. 154(b) by 0 days.

(21) Appl. No.: 16/463,736

(22) PCT Filed: Oct. 10, 2017

(86) PCT No.: PCT/SE2017/050992

§ 371 (c)(1),
(2) Date: May 23, 2019

(87) PCT Pub. No.: WO2018/097777

PCT Pub. Date: May 31, 2018

(30) Foreign Application Priority Data

Nov. 28, 2016 (SE) ..... 1651555

(51) Int. Cl.
*D21F 5/00* (2006.01)
*D21F 9/02* (2006.01)
(Continued)

(52) U.S. Cl.
CPC ..... *D21F 9/003* (2013.01); *D21F 5/181* (2013.01)

(58) Field of Classification Search
None
See application file for complete search history.

(56) References Cited

U.S. PATENT DOCUMENTS 4,073,679 A 2/1978 Schiel
4,523,978 A * 6/1985 Pullinen ..... D21F 1/48 162/300
(Continued)

FOREIGN PATENT DOCUMENTS

DE 10014322 A1 9/2001
DE 10063516 A1 6/2002
(Continued)

OTHER PUBLICATIONS

International Searching Authority, International Search Report and Written Opinion for International Application No. PCT/SE2017/050992, dated Dec. 8, 2017, 10 pages, Sweden.

*Primary Examiner* — Dennis R Cordray
(74) *Attorney, Agent, or Firm* — Alston & Bird LLP

(57) ABSTRACT

The invention relates to a forming section (2) for forming a fibrous web (W). The forming section (2) comprises a first forming fabric (3) arranged to run in a loop supported by guide elements (4) and a second forming fabric (5) arranged to run in a loop supported by guide elements (4). The second forming fabric (5) is arranged so in 5 relation to the first forming fabric (3) that the two forming fabrics (3, 5) converge towards each other to form an inlet gap (6) into which stock can be injected. A forming roll (7) is arranged within the loop of the second forming fabric (5) to guide the second forming fabric (5) into the inlet gap (6) and to guide the first and the second forming fabric (3, 5) along a part of their path which is common to both the first and the second 10 forming fabric (3, 5) and which begins at the inlet gap. The forming roll (7) comprises a flexible tubular jacket (8) which is arranged to run in a loop around an axis of rotation (A) that extends in a direction perpendicular to the direction in which the first and second forming fabric (3, 5) are arranged to run and the forming roll further (7) comprises a support ledge (9) located inside the loop of the flexible
(Continued)

tubular jacket (8) 15 and extending in a direction parallel to the axis of rotation (A) of the flexible tubular jacket (8). The support ledge (9) can press the flexible tubular jacket (8) in a direction outwards away from the axis of rotation (A) such that, in the area in which the flexible tubular jacket (8) is pressed outwards by the support ledge (9), the flexible tubular jacket (8) is caused to follow a path with a radius of curvature which is smaller than the 20 radius of curvature of the flexible tubular jacket (8) outside this area. The invention also relates to a method of forming a fibrous web.

19 Claims, 8 Drawing Sheets

(51) Int. Cl.
*D21F 9/00* (2006.01)
*D21F 5/18* (2006.01)

(56) References Cited

U.S. PATENT DOCUMENTS 6,221,214 B1 * 4/2001 Kotitschke ..... D21F 3/04 162/210
7,387,710 B2 * 6/2008 Bengtsson ..... D21F 3/0218 162/153
8,673,118 B2 * 3/2014 Gorrel ..... D21F 3/06 162/199
8,911,594 B2 * 12/2014 Gustavsson ..... D21F 3/0281 162/358.3
2003/0000672 A1 * 1/2003 Viljanmaa ..... D21F 3/0218 162/205

FOREIGN PATENT DOCUMENTS

EP 2910679 A1 * 7/2011
WO WO-2010/046527 A1 4/2010

* cited by examiner

FORMING SECTION FOR FORMING A FIBROUS WEB, A PAPERMAKING MACHINE COMPRISING A FORMING SECTION AND A METHOD OF FORMING A FIBROUS WEB

CROSS REFERENCE TO RELATED APPLICATIONS

This application is a National Stage Application, filed under 35 U.S.C. 371, of International Application No. PCT/SE2017/050992, filed Oct. 10, 2017, which International Application claims priority to Swedish Application No. 1651555-3, filed Nov. 28, 2016; the contents of both of which as are hereby incorporated by reference herein in their entirety.

BACKGROUND

Related Field

The present invention relates to a forming section for forming a fibrous web, to a papermaking machine comprising a forming section and to a method of forming a fibrous web.

Description of Related Art

In a papermaking machine, the web is first formed in a forming section. In machines for making tissue paper, the forming section typically includes two forming fabrics running in loops around guide rolls. The forming fabrics converge to a gap in which stock is injected by a headbox. Inside one of the forming fabrics, a forming roll is located. The two forming fabrics will run together over a part of the circumference of the forming roll as water is squeezed out of the injected stock that is beginning to form into a fibrous web. The dewatering achieved in the forming section is normally not so high that the web is ready for pressing. To increase the dry solids content of the web, it has been suggested that suction rolls can be used. For example, the forming roll itself may be a suction roll. However, suction rolls require much energy and it would be an advantage if a higher dry solids content could be achieved without using a suction roll. Therefore, it is an object of the present invention to provide a forming section that can achieve a high degree of dewatering without using a suction roll.

BRIEF SUMMARY

The present invention relates to a forming section for forming a fibrous web. The forming section comprises a first forming fabric arranged to run in a loop supported by guide elements and a second forming fabric which is also arranged to run in a loop supported by guide elements. The second forming fabric is so arranged in relation to the first forming fabric that the two forming fabrics converge towards each other to form an inlet gap into which stock can be injected. A forming roll is arranged within the loop of the second forming fabric. The forming roll is arranged to guide the second forming fabric into the inlet gap and to guide the first and the second forming fabric along a part of their path which is common to both the first and the second forming fabric and which begins at the inlet gap. According to the invention, the forming roll comprises a flexible tubular jacket arranged to run in a loop around an axis of rotation that extends in a direction perpendicular to the direction in which the first and second forming fabric are arranged to run. The forming roll further comprises a support ledge that is located inside the loop of the flexible tubular jacket. The support ledge extends in a direction parallel to the axis of rotation of the flexible tubular jacket. The support ledge is arranged to be capable of pressing the flexible tubular jacket in a direction outwards away from the axis of rotation of the flexible tubular jacket in an area along the loop in which the flexible tubular jacket is arranged to run such that, in the area in which the flexible tubular jacket is pressed outwards by the support ledge, the flexible tubular jacket is caused to follow a path with a radius of curvature which is smaller than the radius of curvature of the flexible tubular jacket outside the area in which the support ledge contacts the flexible tubular jacket.

In embodiments of the invention, the support ledge is arranged in a fixed position such that the amount to which the flexible tubular jacket is pressed outwards by the support ledge is constant. For example, the support ledge may be directly supported by or integral with a support beam located inside the loop of the flexible tubular jacket and remain fixed in position in relation to the support beam.

In other embodiments of the invention, at least a part of the support ledge may be arranged to be movable towards or away from the axis of rotation of the flexible tubular jacket such that the amount to which the flexible tubular jacket is pressed outwards by the support ledge can be varied.

In embodiments of the invention, the support ledge is supported by a support beam located inside the loop of the flexible tubular jacket and the at least one actuator may be mounted on the support beam and arranged to be capable of moving the support ledge outwards away from the axis of rotation of the flexible tubular jacket.

In embodiments of the invention, the support ledge has a top surface facing the inner surface of the flexible tubular jacket which top surface is convex.

In some embodiments of the invention, the support ledge can be supported by a support beam and wherein the support ledge can be flexible and/or elastic and comprise an inner cavity that can be supplied with a pressurized fluid such that the support ledge expands and at least a part of the support ledge is caused to move in a direction outwards away from the axis of rotation of the flexible tubular jacket. In such embodiments, the support ledge may advantageously, but not necessarily, be designed such that, when the inner cavity is filled with pressurized fluid such that when the support ledge is in an expanded state, the support ledge has a top surface facing the inner surface of the flexible tubular jacket which top surface is convex.

It should be understood that the support ledge may also be made of a substantially massive block (without an inner cavity) that is made of an elastic material such as rubber or a material with properties comparable to rubber.

The forming section may advantageously comprise a headbox arranged to inject stock into the inlet gap between the first and the second forming fabric. However, the inventive forming section can be sold to a paper mill without a headbox. This may be the case when, for example, the inventive forming section is sold as a part of a rebuild project to a paper mill that already has a head box.

Instead of a support ledge of a flexible material, the support ledge may be a rigid body of a material such as steel, bronze, aluminum or some other metallic material. The support ledge may conceivably also be formed of some other material such as glass or a ceramic material. It could also be made of a rigid or substantially rigid polymeric material. Both when the support ledge is made of a flexible and/or elastic material and when the support ledge is made of a rigid material, the support ledge can be designed such that it has a varying radius such that, as the flexible tubular jacket moves over the support ledge from an end adjacent the inlet gap to a point further away from the inlet gap, the radius of the support ledge will decrease from a greater radius to a smaller radius.

In advantageous embodiments of the invention, the radius of the forming roll in areas not in contact with the support ledge is in the range of 500 mm-1600 mm and the smallest radius of the support ledge is in the range of 40 mm-100 mm, preferably in the range of 45-80 mm and even more preferred in the range of 50 mm-75 mm.

As should be clear from the above description, the support ledge has a top surface that contacts the flexible tubular jacket. The support ledge has a height that can be defined by the distance from the axis of rotation of the flexible tubular jacket to the top surface of the support ledge. It should be understood that the support ledge has, in the direction of rotation of the flexible tubular jacket away from the inlet gap, an upstream end and a downstream end. Preferably, the support ledge is shaped such that, in the direction from the upstream end to the downstream end, the height of the support ledge increases to a peak point where the height of the support ledge reaches its highest value and wherein the peak point of the support ledge is located closer to the downstream end of the support ledge than to the upstream end.

In preferred embodiments of the invention, the flexible tubular jacket is closed at its ends such that the interior of the forming roll is an enclosed space. The forming roll may then be connected to a source of pressurized air or gas such that the flexible tubular jacket can be inflated. During operation, the forming roll can then be inflated by pressurized air such that the flexible tubular jacket can retain its shape.

In all embodiments of the invention, the part of their respective loops that is common to both the first and the second forming fabric extends from a the inlet gap to an end point where the first forming fabric is separated from the second forming fabric. In advantageous embodiments of the invention, the support ledge is located at a point where the first and second fabric follow a common path. Preferably, the support ledge is in its entirety located closer to the end point than to the inlet gap. Preferably, at least the smallest radius of the ledge is located at a point where the first and second forming fabrics follow a common path but which is closer to the end point than to the inlet gap.

The invention also relates to a papermaking machine that comprises the inventive forming section. In embodiments of the inventive machine, the second forming fabric is a felt and the machine may comprise a Yankee drying cylinder. In such embodiments, the second forming fabric, i.e. the felt, is arranged to carry a newly formed fibrous web to the Yankee drying cylinder and transfer the fibrous web to the Yankee drying cylinder in a nip formed between the Yankee drying cylinder and a roll placed within the loop of the second forming fabric.

The invention also relates to a method of forming a fibrous web. The inventive method comprises the step of injecting stock in an inlet gap formed between a first forming fabric and a second forming fabric. Each of the first and second forming fabric is arranged to run in a loop supported by guide elements and wherein a forming roll is located in the loop of the second forming fabric. The forming roll is arranged to guide the second forming fabric into the inlet gap and to guide the first and the second forming fabric along a part of their path which is common to both the first and the second forming fabric and which begins at the inlet gap. The inventive method further comprises the step of causing the forming fabrics to run in their loops such that the stock that is injected into the inlet gap passes between the first and the second forming fabric as the forming fabrics are guided by the forming roll such that water is removed from the injected stock. According to the invention, the forming roll comprises a flexible tubular jacket arranged to run in a loop around an axis of rotation that extends in a direction perpendicular to the direction in which the first and second forming fabric are arranged to run. The forming roll further comprises a support ledge that is located inside the loop of the flexible tubular jacket and extends in a direction parallel to the axis of rotation of the flexible tubular jacket. The support ledge is arranged to be capable of pressing the flexible tubular jacket in a direction outwards away from the axis of rotation of the flexible tubular jacket in an area along the loop in which the flexible tubular jacket is arranged to run such that, in the area in which the flexible tubular jacket is pressed outwards by the support ledge, the flexible tubular jacket is caused to follow a path with a radius of curvature which is smaller than the radius of curvature of the flexible tubular jacket outside the area in which the support ledge contacts the flexible tubular jacket.

In advantageous embodiments of the invention, the method further comprises applying such a tension in the first forming fabric that the pressure applied to the stock reaches a highest value in the range of 8 kPa-20 kPa as the first and second forming fabric pass over the support ledge.

DETAILED DESCRIPTION OF VARIOUS EMBODIMENTS

Figure 1:
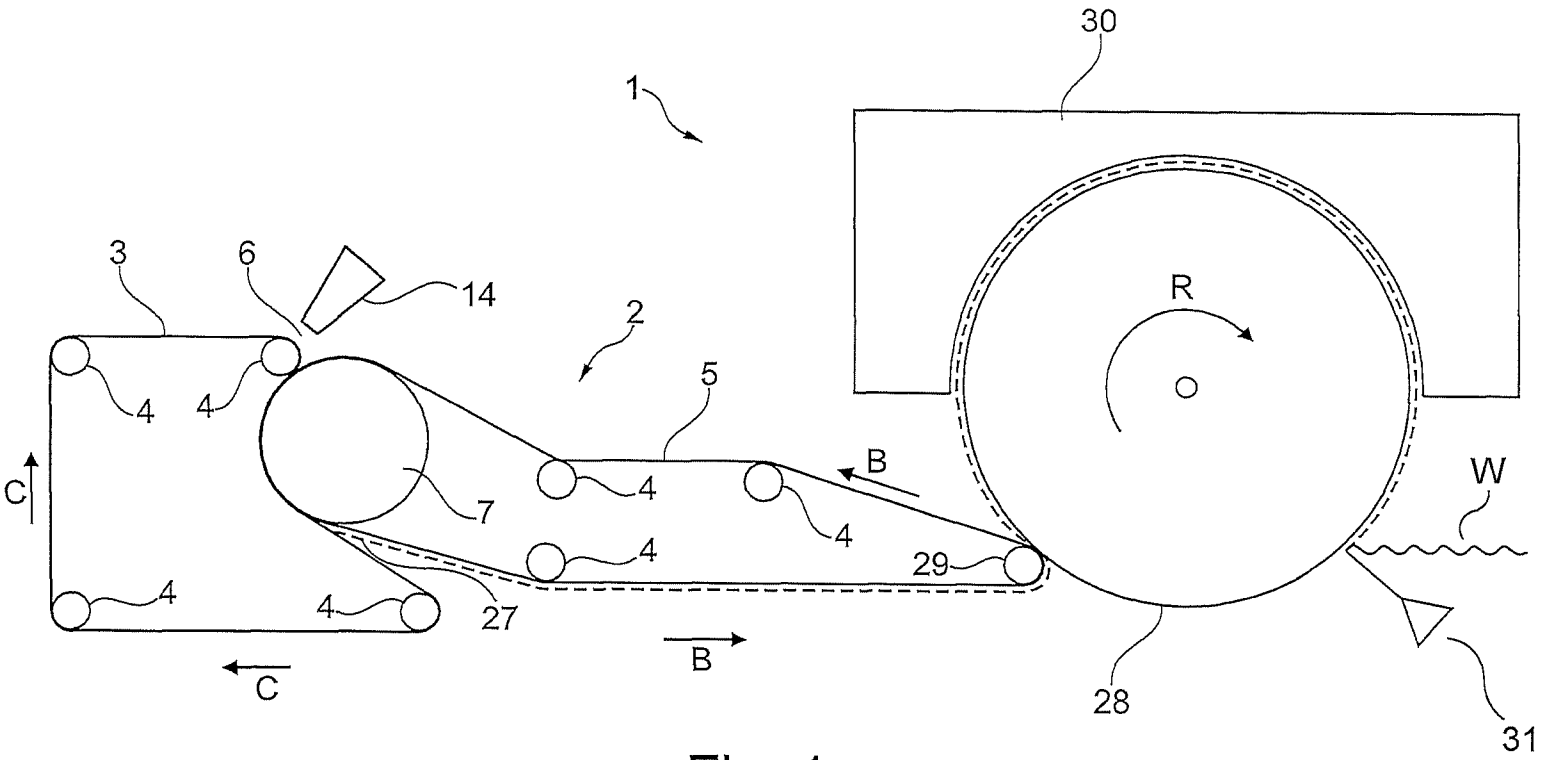
FIG. 1 is a schematic representation of a papermaking machine that can make use of the inventive forming section.

With reference to FIG. 1, a machine 1 for making a fibrous web W is shown. The machine of FIG. 1 is in particular suited for making a tissue paper web W that may have a dry basis weight (grammage) in the range from 10 g/m$^2$ up to 50 g/m$^2$ or 12 g/m$^2$-40 g/m$^2$. In many cases, the basis weight may be in the range of 15 g/m$^2$-25 g/m$^2$. Tissue webs produced by such a machine may be used for such purposes as, for example, kitchen towel, bathroom tissue, facial tissue or table napkins. The machine 1 shown in FIG. 1 has a Yankee drying cylinder 28 which is preferably (but not necessarily) provided with a Yankee drying hood 30. The Yankee drying cylinder 28 may be connected to a source of hot steam (not shown) that is arranged to supply hot steam to the interior of the Yankee drying cylinder 28 such that the Yankee drying cylinder 28 is heated. Thereby, a fibrous web W that travels over the outer surface of the Yankee drying cylinder 28 can be heated to such an extent that water in the fibrous web W is evaporated. The Yankee drying cylinder is arranged to be rotatable and in operation, it will rotate in the direction indicated by arrow R in FIG. 1. A doctor 31 is arranged to crepe the dried fibrous web from the outer surface of the Yankee drying cylinder 28. The Yankee drying cylinder 1 may be, for example, a Yankee drying cylinder of cast iron but it could also be a welded Yankee drying cylinder. For example, it may be a Yankee drying cylinder as disclosed in U.S. Pat. Nos. 9,206,549 or 8,438,752. The Yankee drying hood 30 may be of any known type and it may be, for example, such a Yankee drying hood as disclosed in EP 2963176 A1.

Before the fibrous web W can be dried on the outer surface of the Yankee drying cylinder 28, it must be formed. The machine 1 of FIG. 1 is provided with a forming section 2 that comprises a first forming fabric 3 that is arranged to run in a loop around guide elements 4. The guide elements 4 are suitably guide rolls that are rotatably journalled. When the forming section 2 is operating, the first fabric 3 will run in the direction indicated by the arrows C such that, in FIG. 1, the first fabric 3 is circulating in its loop in the "clockwise" direction. The forming section 2 also comprises a second forming fabric 5 which is also arranged to run in a loop supported by guide elements 4 that may suitably be guide rolls 4 that are rotatably journalled. When the forming section 2 is operating, the second forming fabric 5 is running in the direction indicated by the arrows B such that, in FIG. 1, the second forming fabric 5 is circulating in its loop in the "counter-clockwise" direction. The second forming fabric 5 is so arranged in relation to the first forming fabric 3 that the two forming fabrics 3, 5 converge towards each other to form an inlet gap 6 into which stock can be injected. The stock can be injected by a headbox 14. The headbox 14 may be of any type suitable for tissue making. For example, it may be a head box as disclosed in U.S. Pat. No. 7,588,663, in U.S. Pat. No. 6,030,500 or in U.S. Pat. No. 5,560,807. However, the skilled person is aware of many commercially available headboxes that could all be suitable for the present invention.

The forming section 2 further comprises a forming roll 7. The forming roll 7 is arranged within the loop of the second forming fabric 5 and the forming roll 7 is arranged to guide the second forming fabric 5 into the inlet gap 6. The forming roll 7 is also arranged to guide the first and the second forming fabric 3, 5 along a part of their path which is common to both the first and the second forming fabric 3, 5 and which begins at the inlet gap.

It should be understood that the inventive forming section 2 may be used in a machine as shown in FIG. 1 and that the inventive forming section fits the general description given above. However, it should be understood that the inventive forming section could also be used in machine layouts that differ from the layout shown in FIG. 1. For example, the inventive forming section 2 may be used in a machine using through air drying (TAD) in which case a Yankee drying cylinder 28 may not be present (although a TAD drying arrangement can also be used in combination with a Yankee drying cylinder). The inventive forming section may also be delivered without a headbox as a part of a rebuild of a machine that already has a headbox.

As the forming fabrics 3, 5 pass over the forming roll in that part of their loops that is common to both fabrics, water will be squeezed out of the stock that has been injected between the forming fabrics 3, 5 such that a fibrous web begins to form. The stock is squeezed or pressed between the two forming fabrics 3, 5 and water will leave the stock through the first forming fabric 3. The stock is dewatered by the pressure that the stock is subjected to as it travels between the forming fabrics 3, 5. The centrifugal force also assists in throwing the water out through the first forming fabric 3 since the forming fabrics 3, 4 travel over the curved surface of the forming roll which has a shape that is substantially circular cylindrical. The first forming fabric 3 may advantageously be a fabric with a high permeability to water. In particular, the first forming fabric 3 may be a foraminous wire which does not absorb water. The second forming fabric 5 may also be a wire but it can preferably be a water-absorbing felt which is less permeable than the first forming fabric 3. In this way, it will be easier for the water in the stock to pass through the first forming fabric 3.

Figure 2:
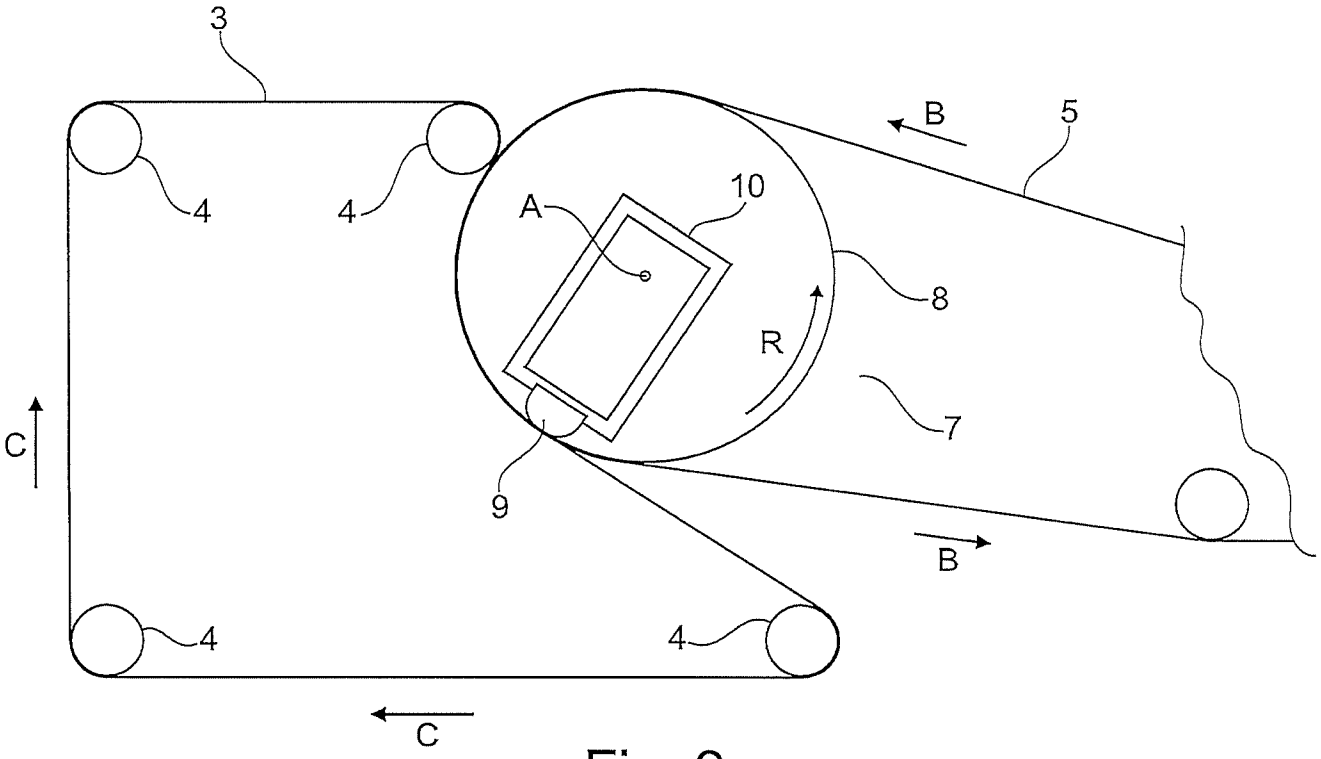
FIG. 2 is a schematic representation of the inventive forming section.

The amount of water that is squeezed or pressed out of the stock as the stock travels between the forming fabrics 3, 5 in that part of their respective paths that is common to both forming fabrics depends to a large extent of the pressure to which the stock is subjected. The pressure to which the stock is subjected can be calculated as $P=T/R$ where P is the pressure to which the stock is subjected, T is the tension in the first forming fabric 3 and R is the radius of the forming roll 7. In theory, it would be possible to increase the pressure simply by using a small forming roll with a correspondingly small radius. However, experience has showed that the draining zone, i.e. the part where the stock travels between two forming fabrics 3, 5, needs to have a certain length. Therefore, a forming section with a forming roll that is too small would be insufficient. Likewise, the tension in the forming fabrics 3, 5 can be increased but there are technical problems also with such a solution, for example the amount of tension to which the forming fabrics 3, 5 can be subjected. Therefore, it is difficult to achieve a dry solids content during forming that is much higher than about 12%. With such a low dry solids content, it is normally not possible to subject the fibrous web to pressing since the web would then risk crushing. Therefore, in order to increase web dryness before pressing, it has been suggested that a suction roll can be placed in the loop of the second forming fabric which suction roll can act through the second forming fabric 5 at a point after the first and second forming fabrics have been separated from each other. An example of such a solution is disclosed in WO 2010/033072 and FIG. 1 of that publication shows a suction roll 25 placed inside the loop of the forming fabric that carries a newly formed web to a press. It has also been suggested that the forming roll itself may be a suction roll and an example of such an arrangement is disclosed in U.S. Pat. No. 6,821,391 in which FIG. 2 shows a forming section with a forming roll 18 that is a suction roll with a suction zone 38. However, suction rolls require much energy for their operation which of course also costs money. In addition, suction rolls make noise. Therefore, it is desirable to find a solution that can give a higher dry solids content during forming even when a suction roll is not used. The present invention offers a solution to this technical problem.

The inventive forming section will now be explained in greater detail with reference to FIG. 2 and FIG. 3.

Figure 7:
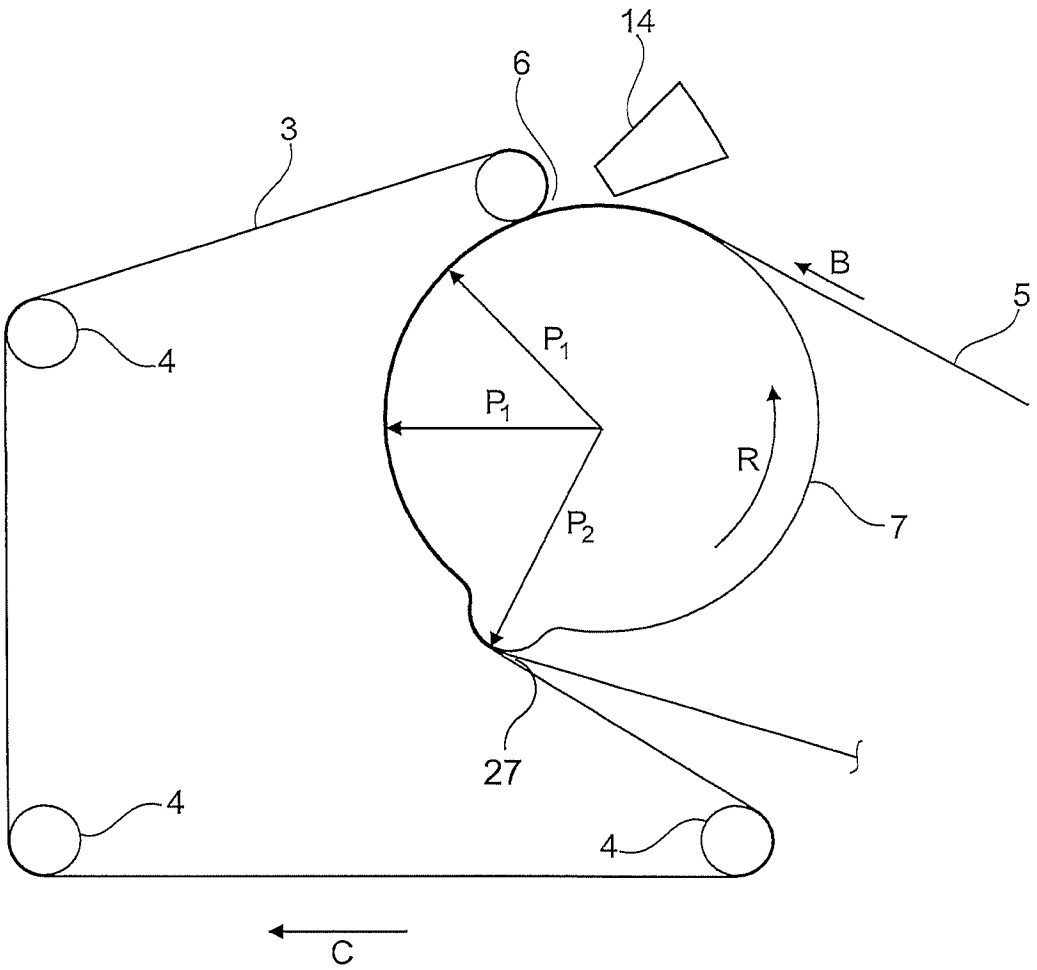
FIG. 7 is a schematic representation of the varying pressure level along the common path of the two forming fabrics.

In FIG. 2, it can be seen how the forming roll 7 has a shell 8. The shell 8 is a flexible tubular jacket that may also be termed "a sleeve". The flexible tubular jacket 8 or sleeve may advantageously be made of a polyurethane or a material that partially comprises polyurethane or has material properties similar to those of polyurethane. The flexible tubular jacket 8 is arranged to run in a loop around an axis of rotation A. In other words, the flexible tubular jacket 8 is arranged to rotate. It should be understood that, in FIG. 2, the flexible tubular jacket (the sleeve) will be rotating in the direction indicated by the arrow R. It should likewise be understood that, just as in FIG. 1, the first forming fabric 3 moves in the direction indicated by the arrows C and the second forming fabric 5 moves in the direction indicated by the arrows B. It should be understood that the axis of rotation A for the flexible tubular jacket 8 extends in a direction that is perpendicular to the direction in which the first and second forming fabrics 3, 5 are arranged to run, i.e. it extends in the cross machine direction, of the forming section. It should be understood that, in FIG. 2, the flexible tubular jacket will rotate in the direction of arrow R when the forming section is operating. The actual thickness of the belt may be selected while taking the choice of material into consideration and factors such as machine speed, machine width and other factors. However, in many realistic embodiments, the flexible tubular jacket may have a thickness in the range of 2-7 mm. For example, it may have a thickness that is 3 mm, 4 mm or 5 mm. The flexible tubular jacket 8 may also comprise several layers of different materials. As can be seen in FIG. 7, the forming roll further comprises a support ledge 9 that is located inside the loop of the flexible tubular jacket 8 and extends in a direction parallel to the axis of rotation A of the flexible tubular jacket 8. Of course, the flexible tubular jacket 8 itself extends in the same direction. The support ledge 9 is arranged to be capable of pressing the flexible tubular jacket 8 in a direction outwards away from the axis of rotation A of the flexible tubular jacket 8 in an area along the loop in which the flexible tubular jacket 8 is arranged to run. This has the result that, in the area in which the flexible tubular jacket 8 is pressed outwards by the support ledge 9, the flexible tubular jacket 8 is caused to follow a path with a radius of curvature which is smaller than the radius of curvature of the flexible tubular jacket 8 outside the area in which the support ledge 9 contacts the flexible tubular jacket 8.

In the embodiment of FIG. 2, the support ledge 9 is supported by a support beam 10 to which the support ledge is directly or indirectly fastened. The support beam 10 may be a welded box beam but other sorts of support beams could also be used, for example a support beam of cast iron.

The flexible tubular jacket 8 is preferably impermeable to water but embodiments are conceivable in which the flexible tubular jacket is permeable to water. If the flexible tubular jacket 8 is impermeable to water, which it preferably is, this assists in making the water in the stock pass out through the first forming fabric 3.

From the above description, those skilled in the art to which the invention pertains will now understand that the forming roll 7 with the flexible tubular jacket 8 is substantially similar to a shoe press unit such as a shoe press roll. Such units are sold commercially under such trade names as SymBelt™ shoe press or NipcoFlex shoe press and have been described in many patent publications, for example in U.S. Pat. Nos. 7,387,710 or 5,662,777. The support ledge 9 may alternatively be called "support body" or "elongate support body". The support ledge 9 could also equally well be termed "shoe" since it is placed in the position where a shoe would be placed in a shoe press unit. However, while the support ledge 9 of the present invention is used in connection with dewatering while a certain pressure is applied as the forming fabrics 3, 5 pass over the support ledge, the purpose of the support ledge 9 differs in some ways from that of a shoe in a shoe press as will be explained in the following.

Since the support ledge 9 is capable of pressing the flexible tubular jacket 8 outwards, it can achieve the effect that, over a part of the circumference of the flexible tubular jacket 8, the radius becomes smaller. Over that part of the circumference of the flexible tubular jacket 8, the pressure to which the stock is subjected will rise and have a peak that it would otherwise not have. The support ledge 9 is arranged to or capable of pressing the flexible tubular jacket 8 out from the path it follows at those parts of its circumference where it does not pass over the support ledge 9. As the support ledge 9 does this, it forces the flexible tubular jacket 8 and the forming fabrics 3, 5 to follow a path where the radius over which the fabrics 3, 5 pass is actually smaller than what is the case at other points along the circumference of the flexible tubular jacket. As a result, the pressure to which the stock is subjected increases as the forming fabrics 3, 5 pass over that part of the forming roll 7 where the support ledge 9 is acting.

Figure 3:
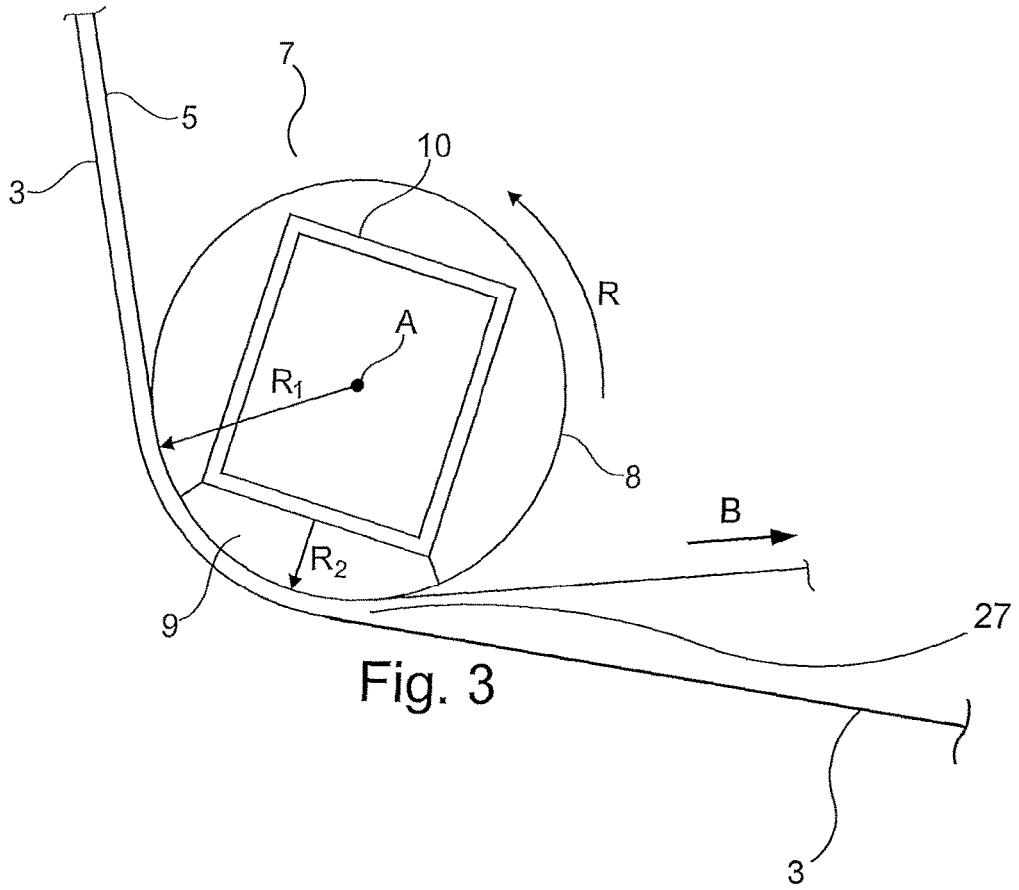
FIG. 3 is a Figure that shows, in greater detail, a possible embodiment of some components of the forming section of FIG. 2.

With reference to FIG. 3, the first forming fabric 3 and the second forming fabric 5 are caused to run together around the forming roll 7. Initially, they follow a curve defined by a first radius $R_1$ of the forming roll 7. The radius $R_1$ may be understood as the radius from the axis of rotation A of the flexible tubular jacket 8. As the forming fabrics 3, 5 pass over the support ledge 9, they will be forced to follow a curve with a radius $R_2$ which is defined by the shape of the support ledge 9. The radius $R_2$ is smaller than the radius $R_1$ and the pressure will thus increase such that the dewatering is intensified as the forming fabrics pass over the support ledge 9. It should be understood that the radius of the support ledge 9 may vary in the machine direction from the upstream end of the support ledge 9 to the downstream end of the support ledge 9.

In embodiments of the invention, the support ledge 9 can be arranged in a fixed position such that the amount to which the flexible tubular jacket 8 is pressed outwards by the support ledge 9 is constant. For example, the support ledge 9 may be directly supported by or integral with a support beam 10 located inside the loop of the flexible tubular jacket 8 and remain fixed in position in relation to the support beam 10.

Figure 4:
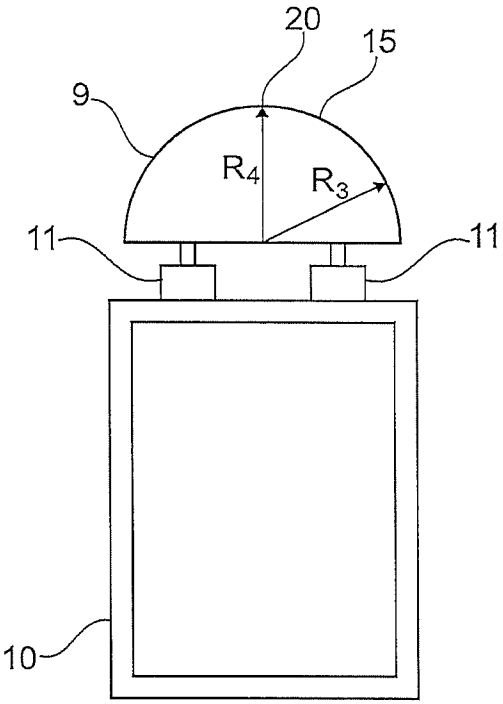
FIG. 4 shows a possible embodiment of a support ledge mounted on a support beam.

Instead of a support ledge 9 that is held in a fixed position, it could be so that at least a part of the support ledge 9 is arranged to be movable towards or away from the axis of rotation A of the flexible tubular jacket 8 such that the amount to which the flexible tubular jacket 8 is pressed outwards by the support ledge can 9 be varied. Possible embodiments of such an arrangement will now be explained with reference to FIG. 4-6. In FIG. 4, a support ledge 9 is shown that is supported by a support beam 10. In FIG. 4, two actuators 11 are shown and the actuators 11 may be hydraulic cylinders as is known from shoe press technology. The actuators 11 are supported by and fixed/secured to the support beam 10 and the actuators 11 are arranged to be capable of acting on the support ledge 9 to press it outwards and thereby also press the flexible tubular jacket 8 outwards. It should be understood that the two actuators 11 that are shown in FIG. 4 may represent two rows of actuators 11 that extend in the cross machine direction (see also FIG. 8).

Figure 5:
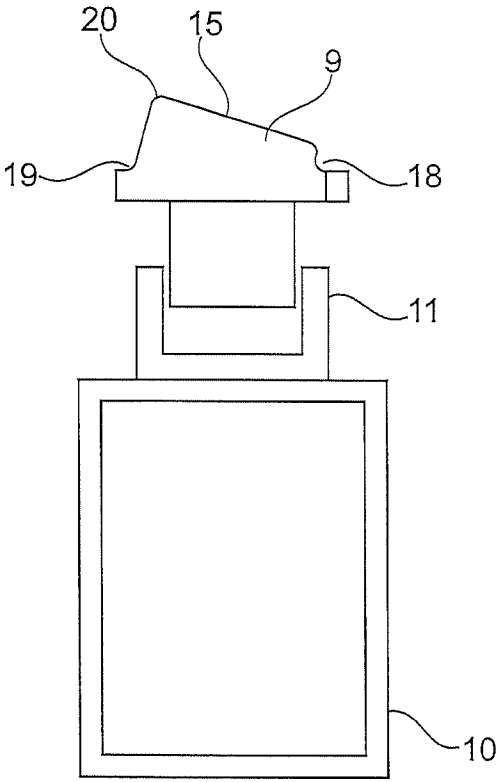
FIG. 5 is a figure similar to FIG. 4 but showing a possible other embodiment of a support ledge.
Figure 6:
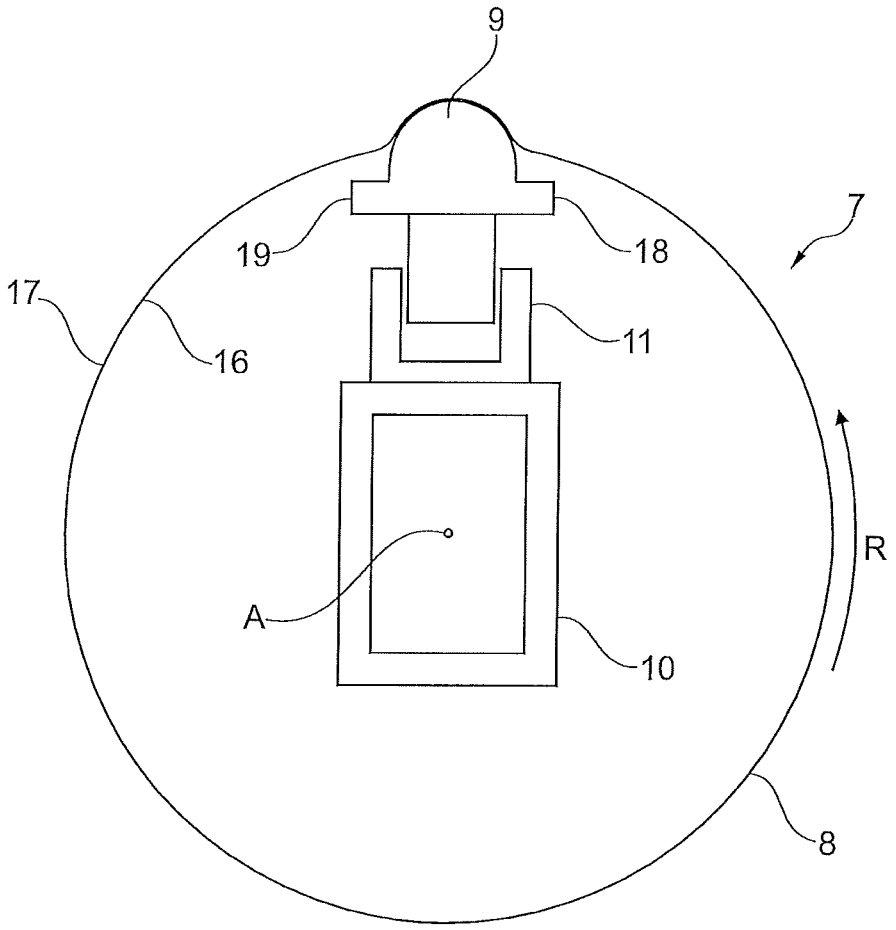
FIG. 6 shows the support ledge of FIG. 5 mounted inside a flexible tubular jacket.
Figure 8:
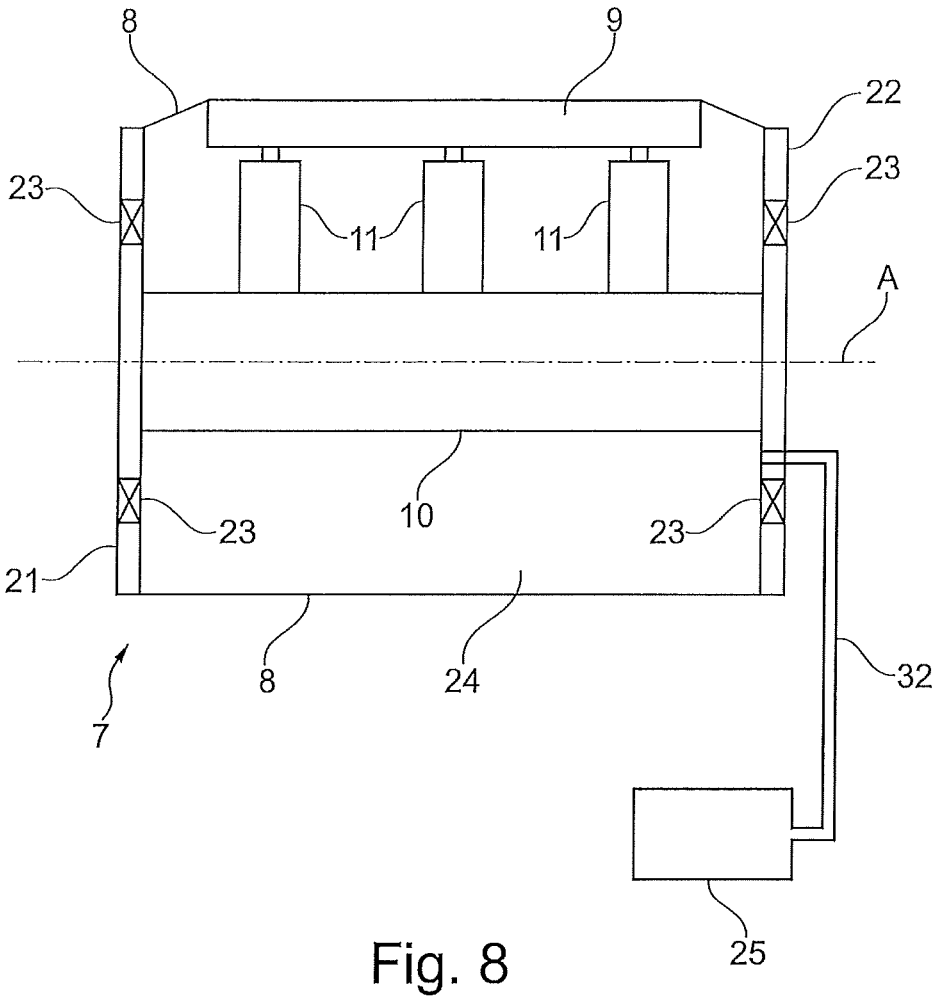
FIG. 8 is a schematic representation in cross section of a forming roll for the inventive forming section.

FIG. 5 and FIG. 6 show an arrangement in which only one actuator 11 can be seen in the figures but it should be understood that this single actuator 11 may represent a row of actuators that extend in the cross-machine direction (see also FIG. 8).

However, it should be understood that the actuator 11 of FIG. 5 and FIG. 6 may be formed as a single actuator extending in the cross-machine direction (the CD direction) which may even be integral with the support ledge 9. Such a design of an actuator is known from, for example, U.S. Pat. No. 5,223,100 that relates to a shoe press but a similar arrangement may be used also for the forming roll according to the present invention. If several actuators 11 are used, the arrangement and design of the actuators could be similar to or identical to any known arrangement of actuators for a shoe in a shoe press. For example, the actuator 11 or actuators 11 could be designed and arranged as disclosed in U.S. Pat. Nos. 5,662,777, 6,083,352, 7,387,710, 4,917,768 or European patent No. 2808442. However, other actuator arrangements for shoe presses are also known from the patent literature and from what is commercially available on the market and those skilled in the art of paper making can select among known solutions for actuators.

It will now be understood that the at least one actuator 11 is arranged to be capable of moving the support ledge 9 outwards away from the axis of rotation A of the flexible tubular jacket 8. By having the support ledge 9 supported by/carried by the support beam 10 which is located inside the loop of the flexible tubular jacket 8 and at least one actuator 11 mounted on the support beam 10, the technical effect is achieved that the at least one actuator 11 can vary the amount to which the flexible tubular jacket (the sleeve) is pressed outwards from its otherwise circular cylindrical path.

With continued reference to FIGS. 4-6, it can be seen that the support ledge 9 has a top surface 15 which is facing the inner surface 16 of the flexible tubular jacket 8 (see FIG. 6) and contacts the inner surface 16 of the flexible tubular jacket 8, at least when the inventive forming section 2 is operating. In the embodiment of FIG. 4, the top surface 15 is convex and the top surface 15 of the support ledge 9 (i.e. the surface that faces the inner surface 16 of the flexible tubular jacket 8) has a varying radius such that, as the flexible tubular jacket 8 moves over the support ledge 9 from an end adjacent the inlet gap 6 to a point further away from the inlet gap 6, the radius of the support ledge 9 will decrease from a greater radius to a smaller radius. In FIG. 4, it can be seen that, at one end of the support ledge 9, the support ledge 9 (or the top surface 15 of the support ledge 9) has a radius $R_3$. The top surface 15 has a peak point 20, i.e. the highest point on the top surface 15 that is at the greatest distance from the axis of rotation A of the flexible tubular jacket 8. At the peak point 20, the radius $R_4$ of the support ledge 9 (i.e. the radius of its top surface 15) is smaller such that $R_4<R_3$. The radius of the support ledge 9 will thus decrease from a higher value to a smaller value which is reached when the amount to which the flexible tubular jacket 8 is pressed outwards from its otherwise circular path reaches its maximum. This will lead to a peak in the pressure to which the stock between the forming fabrics 3, 5 is subjected and the dewatering will increase.

Reference will now be made only to FIG. 5 and FIG. 6. In the embodiment of FIG. 5 and FIG. 6, the support ledge 9 is designed such that, in the direction of rotation of the flexible tubular jacket 8 (see FIG. 6 in which the arrow R indicates the direction of rotation of the flexible tubular jacket 8), the top surface 15 of the support ledge 9 increases in height to a peak point 20 that is closer to the downstream end 19 of the support ledge 9 than to the upstream end 18. In this way, the pressure peak is not reached until the end of the area of the support ledge 9 and the pressure is built up gradually until it goes down after the peak point 20. By this design of the support ledge 9, a sudden pressure pulse can be avoided which might otherwise have damaged the fibrous web that is forming.

In many realistic embodiments of the invention, the radius of the forming roll 7 in areas not in contact with the support ledge 9 is in the range of 500 mm-1600 mm. The smallest radius of the support ledge 9 may then be in the range of 40 mm-100 mm, preferably in the range of 45-80 mm and even more preferred in the range of 50 mm-75 mm. The amount to which the support ledge 9 is pressed outwards must then be sufficient for achieving the effect that, as the forming fabrics 3, 5 pass over the area of the support ledge 9, the forming fabrics must actually conform to and follow the smaller radius of the top surface 15 of the support ledge 9 such that the fabrics 3, 5 are forced to follow a path with a radius that is smaller than that of the forming roll 7 in areas where the flexible tubular jacket 8 is not in contact with the support ledge 9. In many realistic embodiments, this means that the support ledge 9 will press the flexible tubular jacket out from its otherwise circular cylindrical path by distance in the range of 2 mm-20 mm but other values are conceivable and the exact amount may vary depending on the diameter of the forming roll and the length of the support ledge in the circumferential direction of the flexible tubular jacket 8.

If the radius of the top surface 15 of the support ledge decreases gradually from a greater value to a smaller value, this has the technical effect that the pressure to which the stock is subjected rises gradually which can provide for a smoother dewatering without a sudden pressure pulse that may harm the web that is forming.

Figure 9:
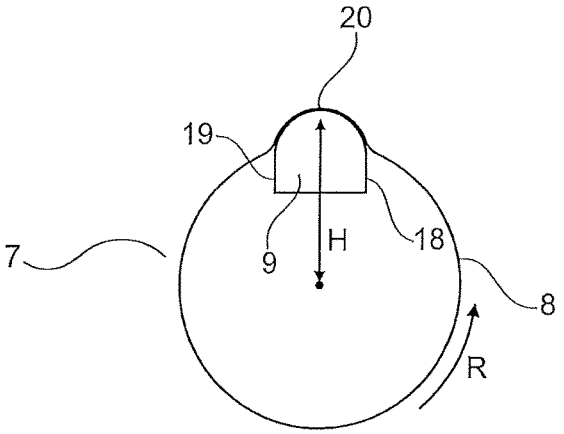
FIG. 9 is a figure similar to FIG. 6 but intended to illustrate another aspect of the invention.

Reference will now be made to FIG. 9 to further explain how the embodiment of FIG. 4 differs from that of FIG. 5 and FIG. 6. As previously explained, the support ledge 9 has a top surface 15 that contacts the flexible tubular jacket 8. The height H of the support ledge 9 can be defined as the distance from the axis of rotation A of the flexible tubular jacket 8 to the top surface 15 of the support ledge 9. In the direction of rotation R of the flexible tubular jacket 8, the support ledge 9 has an upstream end 18 and a downstream end 19 and the support ledge 9 is shaped such that, in the direction from the upstream end 18 to the downstream end 19, the height H of the support ledge 9 increases to a peak point 20. In the embodiment of FIG. 4 and as indicated in FIG. 9, the peak point 20 is symmetrically placed such that it has the same distance to the upstream end 18 as to the downstream end 19. In the embodiment shown in FIG. 5 and FIG. 6, the peak point is asymmetrically placed such that the peak point 20 of the support ledge 9 is located closer to the downstream end 19 of the support ledge 9 than to the upstream end 18, i.e. the height H of the support ledge 9 reaches its highest value at a point closer to the downstream end 19 than to the upstream end 18. When the forming roll 7 according to the invention is placed in the forming section 2 and operating, the upstream end 18 will be that end of the support ledge 9 that is closest to the inlet gap 6 of the forming section.

Figure 10:
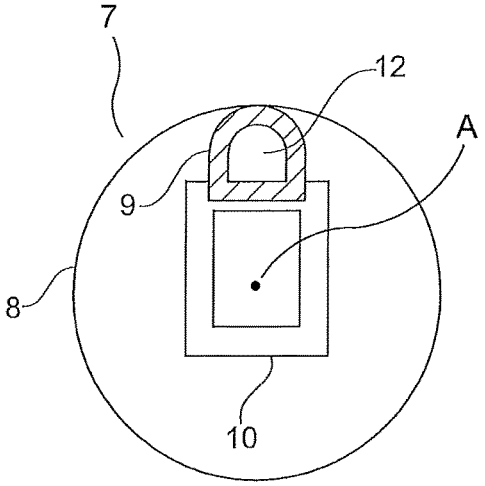
FIG. 10 is a schematic representation of another embodiment in a state which is inactive.
Figure 11:
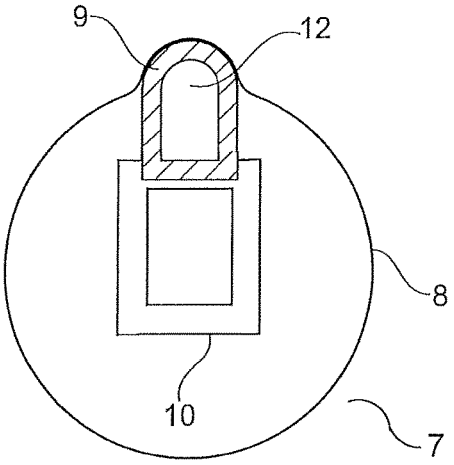
FIG. 11 is a representation of the same embodiment as in FIG. 10 but in an active state.

Another embodiment of the inventive forming section will now be explained with reference to FIG. 10 and to FIG. 11. In FIG. 10, the support ledge 9 is seen supported by a support beam 10. In this embodiment, the support ledge 9 is flexible and/or elastic, i.e. it is made of a material that is flexible and/or elastic. The support ledge 9 of this embodiment comprises an inner cavity 12 that can be supplied with a pressurized fluid such that the support ledge 9 expands and at least a part of the support ledge 9 is caused to move in a direction outwards away from the axis of rotation A of the flexible tubular jacket 8. In FIG. 10, the support ledge 9 is shown in a state in which the inner cavity is not filled with pressurized fluid and the flexible tubular jacket 8 can pass over the support ledge 9 without being forced very much away from its circular path, possibly without being forced out to any extent at all from its circular path. In FIG. 11, the inner cavity 12 has been filled with pressurized fluid such that the support ledge 9 has expanded. As a result, the flexible tubular jacket 8 is forced out from its otherwise circular path as it passes over the support ledge 9. Such a support ledge solution is disclosed in for example U.S. Pat. No. 7,527,708 where a "support body 7" is described and the support ledge 9 of the present invention may have a similar design. The support ledge 9 may then be designed such that, when the inner cavity 12 is filled with pressurized fluid such that when the support ledge 9 is in an expanded state, the support ledge 9 has a top surface 15 facing the inner surface 16 of the flexible tubular jacket 8 and which top surface 15 is convex.

Reference will now again be made to FIG. 1 and to FIG. 2. The part of their respective loops that is common to both the first and the second forming fabric 3, 5 extends from a the inlet gap 6 to an end point 27 where the first forming fabric 3 is separated from the second forming fabric 5. Preferably, the support ledge 9 is placed at a point along the common path of the first and the second forming fabrics 3, 5 that is closer to the end point 27 than to the inlet gap 6 such that the pressure peak is attained at the end or close to the end of the common path of the forming fabrics 3, 5. The smallest radius of the support ledge 9 will then also be located at a point where the first and second forming fabric 3, 5 follow a common path but which is closer to the end point 27 than to the inlet gap 6. In embodiments of the invention, the pressure peak is reached immediately before the end point 27 such that the maximum pressure that the stock (or the forming web) is subjected to is reached at or immediately before the end point 27. In this way, where the dewatering ends with a pressure peak, an effective dewatering can be achieved.

Reference will now be made to FIG. 7. In FIG. 7, it can be seen how the pressure P acting on the stock (or the forming web) between the first forming fabric 3 and the second forming fabric 5 lies at a constant value of P1 over a large part of the circumference of the forming roll 7. However, as the forming fabrics 3, 5 come close to the end point 27 where the forming fabrics are separated from each other, the pressure rises to a higher level, P2. In this way, the pressure peak lies at the end of the zone where the forming web is sandwiched between the two forming fabrics 3, 5.

A further feature will now be explained with reference to FIG. 8. In preferred embodiments of the invention, the flexible tubular jacket 8 is closed at its ends such that the interior of the forming roll 7 is an enclosed space 24. In this embodiment, the forming roll 7 can be connected to a source of pressurized air or gas 25 such that the flexible tubular jacket 8 can be inflated. In FIG. 8, it can be seen that the forming roll 7 has two end walls 21, 22 and bearings 23 allow the end walls 21, 22 to rotate. The bearings 23 can be mounted on a fixed part of the support beam 10. The flexible tubular jacket 8 is fastened at its ends to the end walls 21, 22 and the flexible tubular jacket 8 can be fastened to the end walls 21, 22 in the same way as is known from shoe presses.

Known solutions for fastening the flexible tubular jacket 8 to the end walls 21, 22 are disclosed in, for example, U.S. Pat. Nos. 4,625,376, 5,700,357, 6,010,443, 5,098,523 and 5,904,813. By inflating the flexible tubular jacket 8, the advantage is gained that it will be easier for the tubular flexible jacket 8 to retain its shape.

As an alternative to inflating the tubular flexible jacket 8, it can be provided with supports that do not press it outwards but merely helps it retain its shape (not shown in the figures).

The inventive forming section 2 may further comprise a headbox 14 arranged to inject stock into the inlet gap 6 between the first and the second forming fabric 3, 5. However, the forming section may conceivably be delivered without a headbox, for example as a part of a rebuild of a paper machine that already has a head box.

It is to be understood that the invention may also come in the shape of a papermaking machine 1 that comprises the inventive forming section 2. Such a machine may take many forms but the inventors have in particular contemplated a papermaking machine in which the second forming fabric 5 is a felt and the machine 1 comprises a Yankee drying cylinder 28 as shown in FIG. 1. In such a machine, the second forming fabric 5 may be arranged to carry a newly formed fibrous web W to the Yankee drying cylinder 28 and transfer the fibrous web W to the Yankee drying cylinder 28 in a nip formed between the Yankee drying cylinder 28 and a roll 29 placed within the loop of the second forming fabric 5. The roll 29 may be, for example, an extended nip roll such as a shoe press roll. For example, it may be such a roll as disclosed in U.S. Pat. No. 7,527,708, European patent No. 2085513 or as disclosed in European patent No. 2808442. In the nip between the roll 29 and the Yankee drying cylinder 28, the web W is further dewatered by pressing. The web is at the same time transferred to the smooth outer surface of the Yankee drying cylinder 28. Due to the smooth outer surface of the Yankee drying cylinder, the web will follow the smooth outer surface of the Yankee drying cylinder instead of the (relatively) rough surface of the felt since the web W has a strong tendency to follow the smoothest surface.

Due to the higher dry solids content that has been achieved with the inventive forming section, the newly formed fibrous web can be taken direct to a press nip against the Yankee drying cylinder 28 without having to pass a suction roll.

Embodiments of the machine are conceivable in which the newly formed fibrous web is first brought by the second forming fabric 5 which is a felt to a press nip between to press rolls and then transferred to a following Yankee drying cylinder 28. One of the press rolls may then be an extended nip roll, for example shoe roll. Possible rolls are such rolls that are disclosed in, for example, U.S. Pat. No. 7,527,708, European patent No. 2085513 or as disclosed in European patent No. 2808442.

Embodiments are also conceivable in which both forming fabrics 3, 5 are foraminous wires and in which the second forming fabric transfers the newly formed fibrous web W to a felt that then carries the web W to a nip against a Yankee drying cylinder 28. Alternatively, both forming fabrics 3, 5 can be foraminous wires and the second forming fabric 5 is arranged to carry the web W to a felt. The felt can then be arranged to pass the web through a press nip between two rolls and then to a Yankee drying cylinder.

Embodiments are also conceivable in which the forming section is followed by a through-air drying unit (TAD) and in which the second forming fabric 5 may be a felt or a foraminous wire that carries the web to a TAD wire where the web W can be transferred to the TAD wire, for example by a suction device arranged inside the loop of the TAD wire. The TAD wire can then carry the web W to the through-air drying unit. It is also conceivable that the second forming fabric 5 can be a foraminous wire that is also used as a TAD wire. Examples of through-air drying units are disclosed in, for example, U.S. Pat. No. 6,398,916 and the inventive forming section of the present invention may be used also in an arrangement such as that disclosed in U.S. Pat. No. 6,398,916.

In all embodiments of the inventive machine, the width of the machine may be in the range of 2.5 m-7 m in realistic embodiments. For example, the machine width may be in the range of 3 m-5.5 m.

The invention can also be defined in terms of a method of forming a fibrous web. The method comprises the steps: of injecting stock in an inlet gap 6 formed between the first forming fabric 3 and the second forming fabric 5 while each of the first and second forming fabric 3, 5 is arranged to run in a loop supported by guide elements 4. The forming roll 7 is located in the loop of the second forming fabric 5 as described previously and the forming roll 7 is arranged to guide the second forming fabric 5 into the inlet gap 6 and to guide the first and the second forming fabric 3, 5 along a part of their path which is common to both the first and the second forming fabric 3, 5 and which begins at the inlet gap 6. The forming fabrics 3, 5 are caused to run in their loops such that the stock that is injected into the inlet gap 6 passes between the first and the second forming fabric 3, 5 as the forming fabrics 3, 5 are guided by the forming roll 7 such that water is removed from the injected stock. As explained previously with reference to the inventive forming section, the support ledge 9 will force the flexible tubular jacket 8 outwards from the circular path it otherwise follows such that the flexible tubular jacket 8 is caused to follow a path with a radius of curvature which is smaller than the radius of curvature of the flexible tubular jacket 8 outside the area in which the support ledge 9 contacts the flexible tubular jacket 8. In this way, the forming web will be subjected to a pressure peak.

Optionally, the method may further comprise the step of applying such a tension in the first forming fabric 3 that the pressure applied to the stock (or the forming web) reaches a highest value in the range of 8 kPa-20 kPa as the first and second forming fabric 3, 5 pass over the support ledge 9. This pressure level at the peak of the pressure is suitable to achieve a good dewatering.

In the inventive method, the forming fabrics may move at a speed in the range of, for example, 1200 m/min-2200 m/min. In many realistic embodiments, the forming fabrics 3, 5 may move at a speed in the range of 1600 m/min-2000 m/min. However, the inventive forming section, machine and method may also operate at speeds above 2200 m/min. For example, the speed of operation could be from 2200 m/min up to 2500 m/min or even higher.

The stock used may advantageously be virgin pulp that comprises softwood fibers.

The flexible tubular jacket 8 may be caused to rotate about its axis of rotation A by the forming fabrics 3, 5. Alternatively, if the forming roll is provided with end walls 21, 22, it may be provided with a drive arrangement acting on the end walls 21, 22. Such a drive arrangement is known from shoe calenders and is disclosed in, for example, U.S. Pat. No. 6,158,335.

While the invention offers a possibility to achieve a high dryness without a suction roll, it should be understood that the inventive forming section may optionally include a suction roll located between the separation point 27 and the nip against the Yankee drying roll 28 (see FIG. 1) if even higher dryness is wanted.

Although the invention has been described above in terms of a forming section, a papermaking machine and a method of forming a fibrous web, it should be understood that these categories only reflect different aspects of one and the same invention. The inventive method may thus comprise such steps that would be the inevitable result of operating the inventive forming section and/or the inventive machine, regardless of whether such steps have been explicitly mentioned or not. In the same way, the inventive forming section may comprise means for performing any method step that is part of the inventive method, regardless of whether such steps have been explicitly mentioned or not.

The invention claimed is:

1. A forming section (2) for forming a fibrous web (W), the forming section (2) comprising:

a first forming fabric (3) configured to run in a loop supported by guide elements (4);

a second forming fabric (5) configured to run in a loop supported by guide elements (4), the second forming fabric (5) being arranged in relation to the first forming fabric (3) that the two forming fabrics (3, 5) converge towards each other to form an inlet gap (6) into which stock can be injected; and a forming roll (7) arranged within the loop of the second forming fabric (5), the forming roll (7) being configured to guide the second forming fabric (5) into the inlet gap (6) and to guide the first and the second forming fabric (3, 5) along a part of their path which is common to both the first and the second forming fabric (3, 5) and which begins at the inlet gap, wherein:

the forming roll (7) comprises a flexible tubular jacket (8) which is configured to run in a loop around an axis of rotation (A) that extends in a direction perpendicular to the direction in which the first and second forming fabric (3, 5) are configured to run; and the forming roll further (7) comprises a support ledge (9) located inside the loop of the flexible tubular jacket (8) and extending in a direction parallel to the axis of rotation (A) of the flexible tubular jacket (8) and which support ledge (9) is configured to be capable of pressing the flexible tubular jacket (8) in a direction outwards away from the axis of rotation (A) of the flexible tubular jacket (8) in an area along the loop in which the flexible tubular jacket (8) is configured to run such that, in the area in which the flexible tubular jacket (8) is pressed outwards by the support ledge (9), the flexible tubular jacket (8) is caused to follow a path with a radius of curvature which is smaller than the radius of curvature of the flexible tubular jacket (8) outside the area in which the support ledge (9) contacts the flexible tubular jacket (8).

2. A forming section (2) according to claim 1, wherein the support ledge (9) is arranged in a fixed position such that the amount to which the flexible tubular jacket (8) is pressed outwards by the support ledge (9) is constant.

3. A forming section (2) according to claim 2, wherein the support ledge (9) is directly supported by or integral with a support beam (10) located inside the loop of the flexible tubular jacket (8) and remains fixed in position in relation to the support beam (10).

4. A forming section (2) according to claim 1, wherein at least a part of the support ledge (9) is configured to be movable towards or away from the axis of rotation (A) of the flexible tubular jacket (8) such that the amount to which the flexible tubular jacket (8) is pressed outwards by the support ledge can (9) be varied.

5. A forming section (2) according to claim 4, wherein:

the support ledge (9) is supported by a support beam (10) located inside the loop of the flexible tubular jacket (8); and at least one actuator (11) is mounted on the support beam (10) and configured to be capable of moving the support ledge (9) outwards away from the axis of rotation (A) of the flexible tubular jacket (8).

6. A forming section (2) according to claim 4, wherein:

the support ledge (9) is supported by a support beam (10); and the support ledge (9) is flexible and/or elastic and comprises an inner cavity (12) that can be supplied with a pressurized fluid such that the support ledge (9) expands and at least a part of the support ledge (9) is caused to move in a direction outwards away from the axis of rotation (A) of the flexible tubular jacket (8).

7. A forming section (2) according to claim 1, wherein the forming section (2) further comprises a headbox (14) arranged to inject stock into the inlet gap (6) between the first and the second forming fabric (3, 5).

8. A forming section (2) according to claim 1, wherein the support ledge (9) has a top surface (15) facing the inner surface (16) of the flexible tubular jacket (8) and which top surface (15) is convex.

9. A forming section (2) according to claim 6 wherein, when the inner cavity (12) is filled with pressurized fluid such that when the support ledge (9) is in an expanded state, the support ledge (9) has a top surface (15) facing the inner surface (16) of the flexible tubular jacket (8) and which top surface (15) is convex.

10. A forming section (2) according to claim 8 wherein the support ledge (9) has a varying radius such that, as the flexible tubular jacket (8) moves over the support ledge (9) from an end adjacent the inlet gap (6) to a point further away from the inlet gap (6), the radius of the support ledge (9) will decrease from a greater radius to a smaller radius.

11. A forming section (2) according to claim 10, wherein the radius of the forming roll (7) in areas not in contact with the support ledge (9) is in the range of 500 mm-1600 mm and the smallest radius of the support ledge (9) is in the range of 40 mm-100 mm.

12. A forming section (2) according to claim 11, wherein the smallest radius of the support ledge (9) is in the range of 45-80 mm.

13. A forming section (2) according to claim 11, wherein the smallest radius of the support ledge (9) is in the range of 50 mm-75 mm.

14. A forming section (2) according to claim 8, wherein:

the support ledge (9) has a top surface (15) that contacts the flexible tubular jacket (8) and a height (H) defined by the distance from the axis of rotation (A) of the flexible tubular jacket (8) to the top surface (15) of the support ledge (9);

the support ledge (9) has, in the direction of rotation of the flexible tubular jacket (8) away from the inlet gap (6), an upstream end (18) and a downstream end (19) and the support ledge (9) is shaped such that, in the direction from the upstream end (18) to the downstream end (19), the height (H) of the support ledge (9) increases to a peak point (20) where the height (H) of the support ledge (9) reaches its highest value; and the peak point (20) of the support ledge (9) is located closer to the downstream end (19) of the support ledge (9) than to the upstream end (18).

15. A forming section (2) according to claim 1, wherein:

the flexible tubular jacket (8) is closed at its ends such that the interior of the forming roll (7) is an enclosed space (24); and the forming roll (7) is connected to a source of pressurized air or gas (25) such that the flexible tubular jacket (8) can be inflated.

16. A forming section (2) according to claim 1, wherein:

the part of their respective loops that is common to both the first and the second forming fabric (3, 5) extends from a the inlet gap (6) to an end point (27) where the first forming fabric (3) is separated from the second forming fabric (5); and the smallest radius of the support ledge (9) is located at a point where the first and second forming fabric (3, 5) follow a common path but which is closer to the end point (27) than to the inlet gap (6).

17. A papermaking machine (1) comprising a forming section (2) according to claim 1, wherein:

the second forming fabric (5) is a felt;

the machine (1) comprises a Yankee drying cylinder (28); and the second forming fabric (5) is configured to carry a newly formed fibrous web (W) to the Yankee drying cylinder (28) and transfer the fibrous web (W) to the Yankee drying cylinder (28) in a nip formed between the Yankee drying cylinder (28) and a roll (29) placed within the loop of the second forming fabric (5).

18. A method of forming a fibrous web, the method comprising the steps of:

injecting stock in an inlet gap (6) formed between a first forming fabric (3) and a second forming fabric (5), each of the first and second forming fabric (3, 5) being configured to run in a loop supported by guide elements (4), and wherein a forming roll (7) is located in the loop of the second forming fabric (5) and the forming roll (7) is configured to guide the second forming fabric (5) into the inlet gap (6) and to guide the first and the second forming fabric (3, 5) along a part of their path which is common to both the first and the second forming fabric (3, 5) and which begins at the inlet gap (6);

causing the forming fabrics (3, 5) to run in their loops such that the stock that is injected into the inlet gap (6) passes between the first and the second forming fabric (3, 5) as the forming fabrics (3, 5) are guided by the forming roll (7) such that water is removed from the injected stock, wherein the forming roll (7) comprises a flexible tubular jacket (8) configured to run in a loop around an axis of rotation (A) that extends in a direction perpendicular to the direction in which the first and second forming fabric (3, 5) are configured to run and in that the forming roll further (7) comprises a support ledge (9) located inside the loop of the flexible tubular jacket (8) and extending in a direction parallel to the axis of rotation (A) of the flexible tubular jacket (8) and which support ledge (9) is configured to be capable of pressing the flexible tubular jacket (8) in a direction outwards away from the axis of rotation (A) of the flexible tubular jacket (8) in an area along the loop in which the flexible tubular jacket (8) is configured to run such that, in the area in which the flexible tubular jacket (8) is pressed outwards by the support ledge (9), the flexible tubular jacket (8) is caused to follow a path with a radius of curvature which is smaller than the radius of curvature of the flexible tubular jacket (8) outside the area in which the support ledge (9) contacts the flexible tubular jacket (8).

19. A method according to claim 18, wherein the method further comprises the step of applying such a tension in the first forming fabric (3) that the pressure applied to the stock reaches a highest value in the range of 8 kPa-20 kPa as the first and second forming fabric (3, 5) pass over the support ledge (9).

* * * * *